US008561450B2

(12) United States Patent
Lee et al.

(10) Patent No.: US 8,561,450 B2
(45) Date of Patent: Oct. 22, 2013

(54) SYSTEM AND METHOD FOR ANNEALING OF A PRE-FORMED PANEL

(75) Inventors: Theresa M. Lee, Lake Orion, MI (US); John E. Carsley, Oakland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 318 days.

(21) Appl. No.: 13/045,664

(22) Filed: Mar. 11, 2011

(65) Prior Publication Data

US 2012/0227460 A1 Sep. 13, 2012

(51) Int. Cl.
*B21D 37/16* (2006.01)

(52) U.S. Cl.
USPC ..... 72/342.94; 72/405.01; 72/405.09; 72/426

(58) Field of Classification Search
USPC ..... 72/342.1, 342.94, 342.92, 72/405.01–405.1, 419, 420, 426, 348, 72/349; 901/41, 42, 414; 198/952
See application file for complete search history.

(56) References Cited

U.S. PATENT DOCUMENTS

| | | | | |
|---|---|---|---|---|
| 7,306,451 | B2 * | 12/2007 | Kruger et al. | 425/442 |
| 2010/0040450 | A1 * | 2/2010 | Parnell | 414/752.1 |
| 2010/0192659 | A1 * | 8/2010 | Krajewski et al. | 72/349 |

* cited by examiner

*Primary Examiner* — Dana Ross
*Assistant Examiner* — Matthew G Katcoff
(74) *Attorney, Agent, or Firm* — Quinn Law Group, PLLC

(57) ABSTRACT

A system for annealing a formable panel includes a stamping press configured to pre-form the panel using a first die and a second die. The system also includes a transfer device configured to engage the pre-formed panel and transfer the panel from the stamping press. The transfer device includes a heating element configured to anneal the pre-formed panel. The heating element anneals the pre-formed panel in the stamping press after the first die is disengaged from the panel and while the panel is being supported by the second die. A method of processing a formable panel and a method of processing a pre-formed panel in a multi-stage stamping operation, each using the system, are also disclosed.

11 Claims, 3 Drawing Sheets

SYSTEM AND METHOD FOR ANNEALING OF A PRE-FORMED PANEL

TECHNICAL FIELD

The present invention relates to a system and a method for annealing of a pre-formed panel.

BACKGROUND

Annealing is a heat treatment applied to a material that is intended to alter the material properties such as strength and hardness. Annealing is typically performed by heating the subject material to above the material's re-crystallization temperature, maintaining the selected temperature for a period of time, and then cooling. Annealing is commonly used to improve the material's ductility, relieve internal stresses, refine the material's structure by making it more homogeneous, and improve the material's cold working properties.

Depending on the subject material, following the heating stage, the material may be allowed to cool slowly to ambient conditions, or be cooled more quickly by quenching it in a fluid. Following the annealing process, the material is typically softened sufficiently for further shaping, forming, or stamping.

Stamping of a blank panel into a desired shape may be accomplished through a series of stages. Frequently, the final shape produced by the stamping operation, as well as the rate of production, is limited by the ability of the panel to withstand deformation without developing splits and tears. Annealing can be used during such multi-stage stamping processes to remove strain hardening effects and recover ductility of a partially formed panel, a.k.a., a pre-form, in order to prepare the panel for being formed into the desired final shape.

SUMMARY

A system for annealing a formable panel includes a stamping press configured to pre-form the panel using a first die and a second die. The system also includes a transfer device configured to engage the pre-formed panel and transfer the panel from the stamping press. The transfer device includes a heating element configured to anneal the pre-formed panel. The heating element anneals the pre-formed panel in the stamping press after the first die is disengaged from the panel and while the panel is being supported by the second die.

The transfer device may include a set of stanchions configured to engage the pre-formed panel and hold the panel against the second die. The transfer device may additionally include at least one suction cup operatively connected to at least one of the stanchions. In such a case, the at least one suction cup may be configured to engage and hold the pre-formed panel when the pre-formed panel is being annealed by the heating element and for transferring the panel from the stamping press.

The second die may include a clamping mechanism configured to hold the transfer device relative to the second die when the pre-formed panel is being annealed by the heating element.

The heating element may be configured as an induction coil adapted to generate an electromagnetic force when the pre-formed panel is being annealed. The electromagnetic force may be used to press the pre-formed panel against the second die during the annealing of the pre-formed panel.

The first die may include a set of end-stops configured to engage the transfer device and hold the transfer device relative to the second die when the pre-formed panel is being annealed by the heating element.

The system may also include a cooling device configured to cool the second die during annealing of the pre-formed panel. Additionally, the system may include flexible wiring for the heating element and flexible coolant supply lines for the pre-formed panel. Such flexible wiring and flexible coolant supply lines may be operatively connected to the transfer device.

The transfer device may be configured as one of a linear transfer mechanism, a robotic arm, and a gantry robot. Additionally, the transfer device may be regulated by a controller.

A method of processing a formable panel and a method of processing a pre-formed panel in a multi-stage stamping operation, each using the disclosed system, are also provided.

The above features and advantages and other features and advantages of the present invention are readily apparent from the following detailed description of the best modes for carrying out the invention when taken in connection with the accompanying drawings.

DETAILED DESCRIPTION

Figure 1:
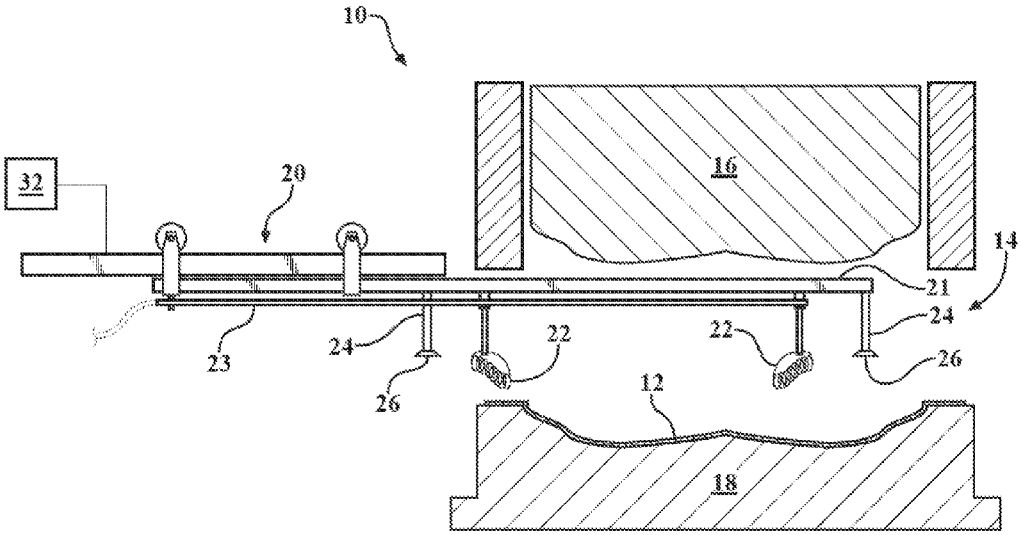
FIG. 1 is a schematic illustration of a system for annealing a formable panel, the system including a stamping press and a transfer device, wherein the transfer device is delivered to anneal a pre-formed panel.

Referring to the drawings in which like elements are identified with identical numerals throughout, FIGS. 1-4 illustrate a system 10 for annealing a pre-formed panel, a.k.a., a pre-form 12. The system 10 includes a stamping press 14. The stamping press 14 is arranged for pre-forming a desired shape from a formable panel, such as a sheet blank, to thereby turn the blank into the pre-form 12. Thus configured, the stamping press 14 may be part of an initial or an intermediate stage in a multi-stage stamping operation that is designed to form a desired final shape from the sheet blank.

The press 14 includes a first or upper forming die 16 and a second or lower forming die 18. For generating a desired pre-form 12 from a sheet blank, the sheet blank is positioned between the forming dies 16 and 18, and the upper forming die is employed to press the blank against the lower forming die. As envisioned, the pre-form 12 may be from any formable base metal, such as steel, aluminum, magnesium, or titanium.

The system 10 also includes a transfer device 20 configured to engage the pre-form 12 and transfer the pre-form from the stamping press 14. As shown in FIGS. 1-4, the transfer device 20 includes end-of-arm tooling 21 that incorporates two heating elements 22. The heating elements 22 are configured to anneal the pre-form 12 in the stamping press 14 while the pre-form remains in the lower die 18. Although two heating elements 22 are shown, any number of heating elements may be used in order to anneal as large or as small an area of the pre-form 12 as needed. Although the sheet blank is described above as being partially formed in the stamping press 14 and then transferred to the next forming stage, the pre-form 12 may also be formed in the stamping press 14, annealed via the heating elements 22, and then pressed into final form in the same stamping press 14.

Each heating element 22 is configured to be activated to anneal the pre-form 12 in the stamping press 14 after the first die 16 becomes disengaged from the pre-form and while the pre-form is being supported by the second die 18. As shown, the heating elements 22 may be electrical devices that can store energy in a magnetic field created by an electric current passing there through. The heating elements 22 may be configured as induction coils using tubes formed from conducting material, such as copper, wherein each induction coil is configured to generate an electromagnetic force when an electric current is being passed through the coil to anneal the pre-form 12.

An induction coil heating element 22 is typically fabricated from copper tubing that is shaped to complement the pre-form 12 that requires annealing. Generally, a coolant is passed through the coil while the electrical current is applied to the walls of the copper tubing to prevent the copper tube from melting. The applied electrical current is typically an alternating current at some predetermined frequency that is provided by an external power supply (not shown) and delivered to the inductor by flexible wiring, while the coolant is delivered by flexible coolant supply lines. The flexible wiring and the flexible coolant supply lines for the coils are both attached to the transfer device 20. The flexible nature of the wiring and the coolant supply lines facilitate the repositioning of the transfer device 20 with respect to the press 14 during the multi-stage stamping operation. The flexible wiring and coolant supply lines may be bundled into a conduit 23, which may in turn be mounted on the transfer device 20, as shown in FIGS. 1-4.

The electrical current provided by the external power supply and passed through the induction coil heating element 22 generates a magnetic field in the coil. Because the pre-form 12 is electrically conductive, the magnetic field generated in the induction coil induces an opposing magnetic field in the pre-form. The two opposing magnetic fields interact to generate a repulsive electromagnetic force. The magnetic field induced in the pre-form 12 generates eddy currents in the pre-form that dissipate as thermal energy, which, in turn, causes the temperature of the pre-form to rise, thus annealing the microstructure of the pre-form.

As a side effect, the electromagnetic force generated by the opposing magnetic fields tends to repel the induction coil heating elements 22 from the surrounding structures, including the pre-form 12. The pre-form 12, however, is often a relatively flexible structure, especially if formed from a sheet of material such as aluminum. Thus, the pre-form 12 may deflect or yield under the action of the electromagnetic force generated by the heating elements 22, if the pre-form is not sufficiently supported. Such deflection of the pre-form 12 may alter the relative spacing between a particular heating element 22 and the area of the pre-form intended to be annealed and adversely affect the penetration depth of the heating effect from the heating element. The deflection of the pre-form 12 during the annealing process may also result in permanent deformation of the pre-form and increase dimensional variation in the final stamped shape.

According to an embodiment of the system 10, when the pre-form 12 is being annealed, the electromagnetic force that is generated by the heating elements 22 may be sufficient to press and hold the pre-form against the second die 18. Hence, the electromagnetic force may be used to act upon the pre-form in order to press the pre-form against the second die 18. In order to take advantage of the electromagnetic force created by the heating elements 22 during annealing of the pre-form 12, the transfer device 20 is characterized by a robust structure to limit its flex when acted upon by the electromagnetic force. The heating elements 22 may additionally be configured integrally with the transfer device 20 to limit deflection of the heating elements relative to the transfer device. Furthermore, although the transfer device 20 is configured to be moved or repositioned with respect to the press 14 during the multi-stage stamping operation, the transfer device is rigidly mounted in its associated supports (not shown). Such rigid mounting of the transfer device 20 is intended to reduce deflection of the transfer device relative to the second die 18.

The transfer device 20 may additionally be securely engaged with the pre-form 12 by a specifically configured device. As shown in FIGS. 1-4, the transfer device 20 may include stanchions 24 configured to engage the pre-form 12 and hold the pre-form against the second die 18. As additionally shown in FIGS. 1, 2, and 4, the transfer device 20 also includes suction cups 26 operatively connected to the stanchions 24. Each of the suction cups 26 is configured to engage and hold the pre-form 12 when the pre-formed panel is being annealed by the heating elements 22. Additionally, the suction cups 26 are configured for transferring the annealed pre-form 12 from the stamping press 14 on to the next stage of the stamping operation (shown in FIG. 4).

Figure 2:
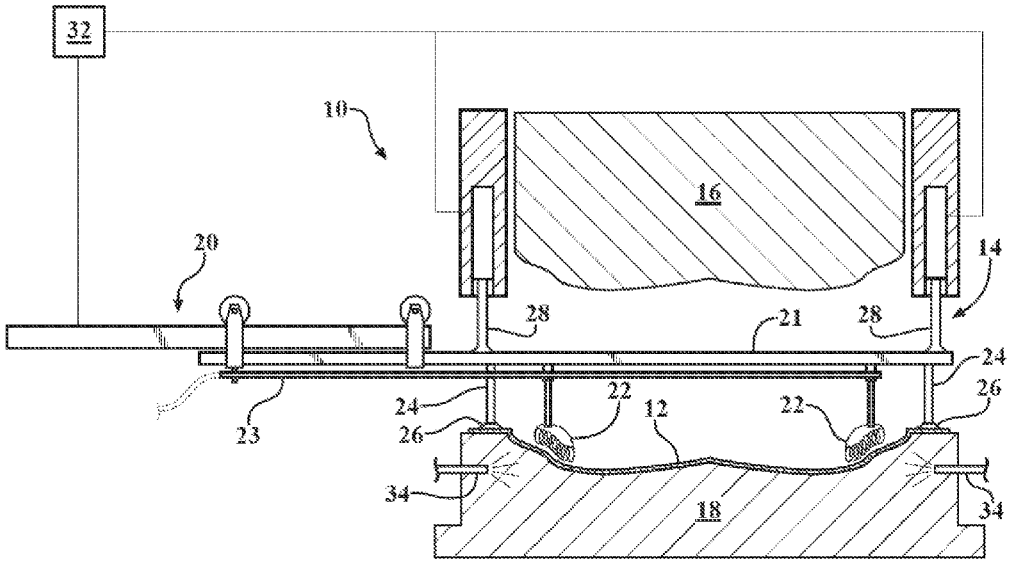
FIG. 2 is a schematic illustration of the system shown in FIG. 1, the transfer device illustrated engaging and annealing the pre-formed panel.

As shown in FIG. 2, the first die 16 may include a set of end-stops 28. The set of end-stops 28 is configured to engage the transfer device 20 and hold the transfer device relative to the second die 18 when the pre-form 12 is being annealed by the heating elements 22. The set of end-stops 28 may be particularly useful when the transfer device 20 is insufficiently robust or its mounting is insufficiently rigid to prevent significant deflection thereof relative to the pre-form 12 during annealing. The set of end-stops 28 may be configured to retract from the first die 16 during annealing of the pre-form 12 in order to hold the transfer device 20 in position relative to the second die 18.

Figure 3:
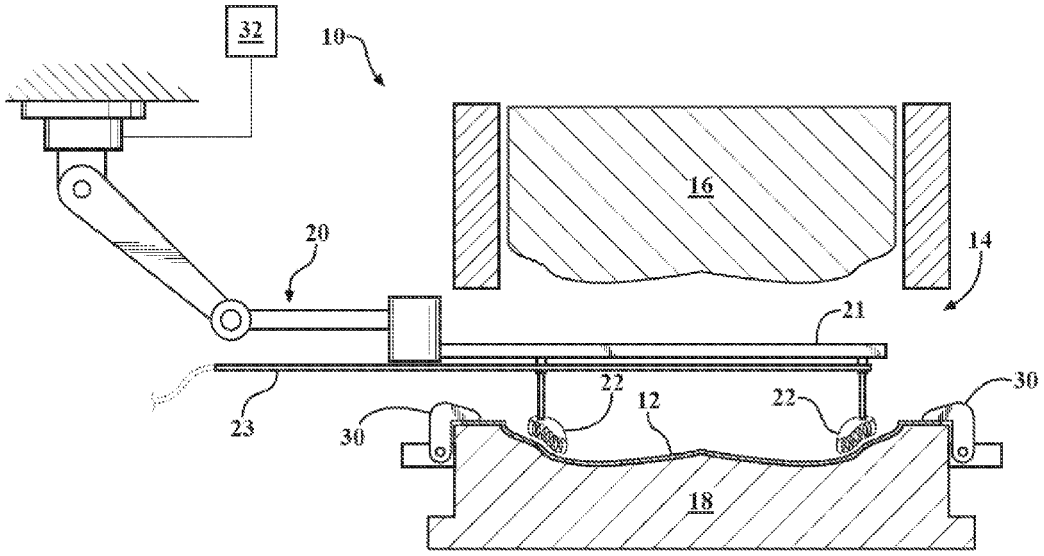
FIG. 3 is a schematic illustration of the system shown in FIG. 1, a lower die of the stamping press is illustrated engaging the transfer device with a clamping mechanism.

As shown in FIG. 3, the second die may include a clamping mechanism 30. The clamping mechanism 30 is configured to hold the transfer device 20 relative to the second die 18 when the pre-formed panel 12 is being annealed by the heating elements 22. The clamping mechanism 30 may be configured to engage the transfer device 20 by an electromechanical or a hydraulic servo (not shown) in order to hold the transfer device in position relative to the second die 18.

Figure 4:
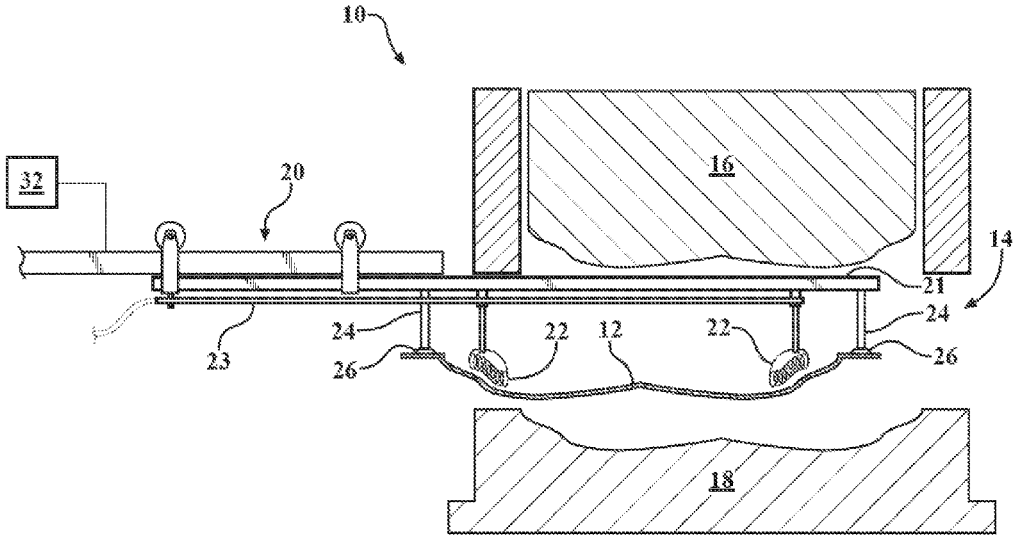
FIG. 4 is a schematic illustration of the system shown in FIG. 1, the transfer device illustrated extracting the annealed pre-formed panel from the stamping press.

The transfer device 20 may be configured as either a linear transfer mechanism, as shown in FIGS. 1, 2, and 4, a robotic arm (not shown) commonly used in transfer stamping lines, or a gantry robot (shown in FIG. 3). A gantry robot is a Cartesian-coordinate industrial robot that is configured to be operated in a straight line rather than rotate along three principal control axes. As shown in each of the FIGS. 1-4, the transfer device 20 is regulated by a controller 32 for transferring the pre-form 12 between stages of the stamping operation. The controller 32 may be additionally programmed to regulate the activation of the heating elements 22, the retraction of the set of end-stops 28 from the first die 16, and/or the engagement of the transfer device 20 with clamping mechanism 30.

An auxiliary cooling of the second die 18 may be provided in order to counteract the energy being absorbed by the second die during the described annealing of the pre-form 12. Such auxiliary cooling may be accomplished via dedicated cooling jets 34, as shown in FIG. 2. The cooling jets 34 may be configured to provide either air or fluid cooling of the second die 18.

Figure 5:
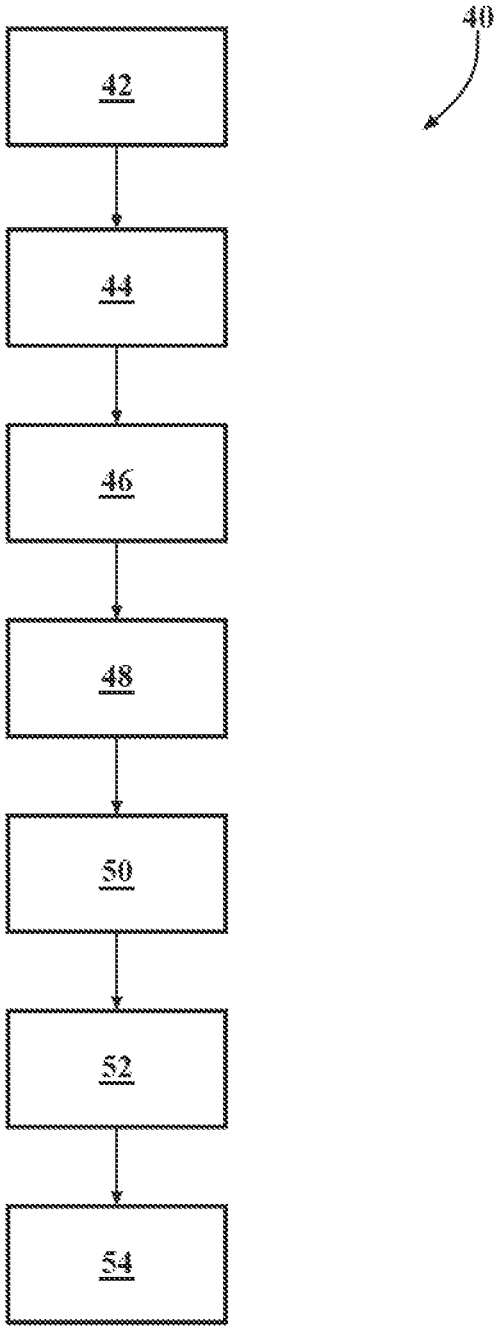
FIG. 5 is a flow chart illustrating a method for stamping of a metal sheet.

FIG. 5 depicts a method 40 of processing a formable panel. Method 40 is herein described with respect to the system 10 for annealing the formable panel as shown in FIGS. 1-4. The method commences in frame 42 where a formable panel is inserted into a first press, depicted as the stamping press 14 in FIGS. 1-4, and then proceeds to frame 44. In frame 44, the method includes pre-forming the panel between the first die 16 and the second die 18 in the stamping press 14, and thus generating the pre-form 12. From frame 44, the method advances to frame 46, where it includes disengaging the first die 16 from the pre-form 12.

After frame 46, the method proceeds to frame 48, where it includes engaging the pre-form 12 with the transfer device 20 while supporting the pre-form by the second die 18. In frame 48, the method may additionally include holding the pre-form 12 against the second die 18 by the stanchions 24 that may include the suction cups 26. Alternatively, holding the transfer device 20 relative to the second die 18 may be accomplished via the clamping mechanism 30.

Following frame 48, the method includes annealing the pre-form 12 in the first press, shown as the stamping press 14, via the heating elements 22 in frame 50. In frame 50, the method may include pressing the pre-form 12 against the second die 18 by the electromagnetic force that is generated the heating elements 22. In frame 50, the method may additionally include holding the pre-form 12 against the second die 18 by the stanchions 24 with the suction cups 26, and may additionally include holding the transfer device 20 relative to the second die via the set of end-stops 28.

After frame 50, the method proceeds to frame 52 where it includes extracting the pre-form 12 from the first press, i.e., the stamping 14, using the transfer device 20. The method then advances to frame 54, where it includes transferring the pre-form 12 to a second press (not shown) of the next stage of the stamping operation using the transfer device 20. The extraction of the pre-form 12 in frame 52 and transfer of the pre-form in frame 54 may be accomplished by the suction cups 26.

While the best modes for carrying out the invention have been described in detail, those familiar with the art to which this invention relates will recognize various alternative designs and embodiments for practicing the invention within the scope of the appended claims.

The invention claimed is:

1. A method of processing a formable panel, the method comprising:

pre-forming the panel between a first die and a second die in a first press;

disengaging the first die;

engaging the pre-formed panel with a transfer device having a heating element while supporting the pre-formed panel by the second die;

annealing the pre-formed panel in the first press via the heating element;

extracting the pre-formed panel from the first press using the transfer device; and transferring the pre-formed panel to a second press using the transfer device.

2. The method of claim 1, wherein said engaging the pre-formed panel with the transfer device is accomplished via stanchions operatively connected to the transfer device, and further comprising holding the panel against the second die by the stanchions.

3. The method of claim 2, wherein said engaging the pre-formed panel and said transferring the panel from the stamping press is accomplished by at least one suction cup operatively connected to at least one of the stanchions, and further comprising holding the panel via the at least one suction cup when the pre-formed panel is being annealed.

4. The method of claim 1, further comprising holding the transfer device relative to the second die via a clamping mechanism operatively connected to the second die when the pre-formed panel is being annealed.

5. The method of claim 1, further comprising pressing the pre-formed panel against the second die using an electromagnetic force generated by the heating element when the pre-formed panel is being annealed, wherein the heating element is configured as an induction coil.

6. The method of claim 1, wherein said engaging the transfer device is accomplished via a set of end-stops operatively connected to the first die, and further comprising holding the transfer device relative to the second die via the set of end-stops when the pre-formed panel is being annealed.

7. The method of claim 1, further comprising regulating the transfer device by a controller, and wherein the transfer device is configured as one of a linear transfer mechanism, a robotic arm, and a gantry robot.

8. A method of processing a pre-formed panel in a multi-stage stamping operation, the method comprising:

regulating a transfer device via a controller to engage the pre-formed panel after the panel is stamped between a lower die and an upper die during a first stage of the stamping operation, wherein the transfer device includes a heating element;

supporting the pre-formed panel by the lower die;

regulating the heating element via the controller to anneal the pre-formed panel in the lower die; and regulating the transfer device via the controller to transfer the pre-formed panel to a second stage of the stamping operation.

9. The method of claim 8, wherein said engaging the pre-formed panel and said transferring the panel from the stamping press is accomplished by at least one suction cup operatively connected to at least one stanchion, and wherein the at least one stanchion is operatively connected to the transfer device, and further comprising holding the panel via the at least one suction cup when the pre-formed panel is being annealed.

10. The method of claim 8, further comprising holding the transfer device relative to the second die via a clamping mechanism operatively connected to the second die when the pre-formed panel is being annealed.

11. The method of claim 8, wherein said engaging the transfer device is accomplished via a set of end-stops operatively connected to the first die, and further comprising holding the transfer device relative to the second die via the set of end-stops when the pre-formed panel is being annealed.

* * * * *